US007128536B2

(12) United States Patent
Williams et al.

(10) Patent No.: US 7,128,536 B2
(45) Date of Patent: Oct. 31, 2006

(54) DAMPED AEROFOIL STRUCTURE

(75) Inventors: David A. Williams, Bristol (GB); Christopher A. Powell, Cardiff (GB)

(73) Assignee: Rolls-Royce PLC, London (GB)

( * ) Notice: Subject to any disclaimer, the term of this patent is extended or adjusted under 35 U.S.C. 154(b) by 71 days.

(21) Appl. No.: 10/830,118

(22) Filed: Apr. 23, 2004

(65) Prior Publication Data

US 2004/0253115 A1 Dec. 16, 2004

(30) Foreign Application Priority Data

Jun. 10, 2003 (GB) ..... 0313303.0

(51) Int. Cl.
*F03B 11/04* (2006.01)

(52) U.S. Cl. ..... 416/229 R; 416/500

(58) Field of Classification Search ..... 416/119, 416/229 R, 230, 229 A, 500
See application file for complete search history.

(56) References Cited

U.S. PATENT DOCUMENTS 2,642,263 A * 6/1953 Thorp ..... 416/233
2,921,769 A * 1/1960 Flader ..... 416/92
4,188,171 A * 2/1980 Baskin ..... 416/226
5,056,738 A 10/1991 Mercer et al. ..... 244/54
5,284,011 A * 2/1994 Von Benken ..... 60/796
5,384,959 A * 1/1995 Velicki ..... 29/889.72
6,524,074 B1 * 2/2003 Farrar et al. ..... 416/229 R

FOREIGN PATENT DOCUMENTS

| | | |
|---|---|---|
| EP | 0568201 A1 | 4/1993 |
| GB | 2 154 286 A | 9/1985 |
| GB | 2269555 A | 2/1994 |
| GB | 2306353 A | 5/1997 |
| JP | A 57143103 | 9/1982 |

* cited by examiner

*Primary Examiner*—Edward K. Look
*Assistant Examiner*—Devin Hanan
(74) *Attorney, Agent, or Firm*—Oliff & Berridge, PLC

(57) ABSTRACT

A damped airfoil structure comprises an airfoil having a first wall and a second opposing wall, and vibration damping means for damping relative movement of the first and second wall. The damping means comprises at least two cooperating damping elements, a first damping element mounted to the first wall of the structure and a second damping element mounted to the second wall of the structure.

22 Claims, 7 Drawing Sheets

DAMPED AEROFOIL STRUCTURE

The present invention relates to a damped aerofoil structure. It is particularly suitable for use in gas turbine engines, and axial flow compressors.

In the case of turbofans and lift fans, it is beneficial to have "wide-chord" fan blades with a low aspect ratio (i.e. height to chord ratio) to maximise the mass flow and pressure rise. With the advent of advanced construction techniques, as described in European Patent EP568201 and British Patent GB2306353, wide-chord fan blades can now be made light enough for use in gas turbines aero-engines.

In the past, rotors in compressors have comprised aerofoils attached to a disc by mechanical fastenings, typically a utilising a dovetail arrangement as is well known in the art. Such an arrangement imposes an undesirable weight penalty due to the discontinuous annulus of "dead material" about the disc necessary to fix the blades but which cannot support hoop stress. Recently, integrally bladed discs, known as blisks have begun to supersede conventional disc/blade arrangements. Blisks are machined from a solid ingot, or forging, by computer numerically controlled (CNC) machining or are fabricated by bonding aerofoil blades to a disc. Such a construction eliminates the "dead material" mentioned above to give a useful reduction in mass over conventional disc/blade arrangements.

It is an object of the present invention to provide a damped aerofoil to offset the loss of damping caused by the removal of mechanical fastening between blade and disc. It will be understood, however that the present invention is equally applicable to mechanically fixed blades and to static aerofoil components.

According to the broadest aspect of the present invention, a damped aerofoil structure comprises, an aerofoil having a first wall and a second wall which together define an enclosed cavity, and vibration damping means located within the cavity, wherein the damping means comprises at least two damping elements in frictional engagement, a first damping element mounted to the inner surface of the first wall of the structure and a second damping element mounted to the inner surface of the second wall of the structure.

The invention will now be discussed with reference to the accompanying drawings in which.

Figure 1:
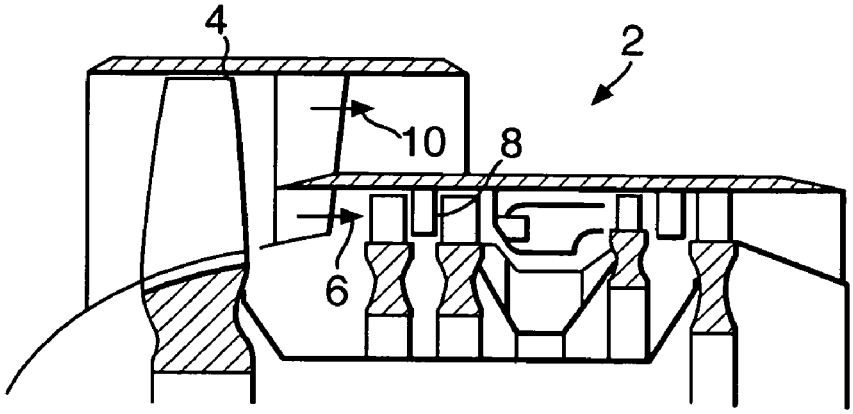
FIG. 1 shows a schematic cross-section of a notional turbofan engine.

FIG. 1 shows, in schematic form, a cross section of a turbofan 2, which has a fan 4 comprising a low-pressure axial-flow compressor, which in operation provides a first core flow of compressed air 6 to a downstream compressor 8 and a second flow of by-pass air 10. The fan 4 comprises a rotary first stage and static secondary stage and these will be further described with reference to FIG. 2

Figure 2:
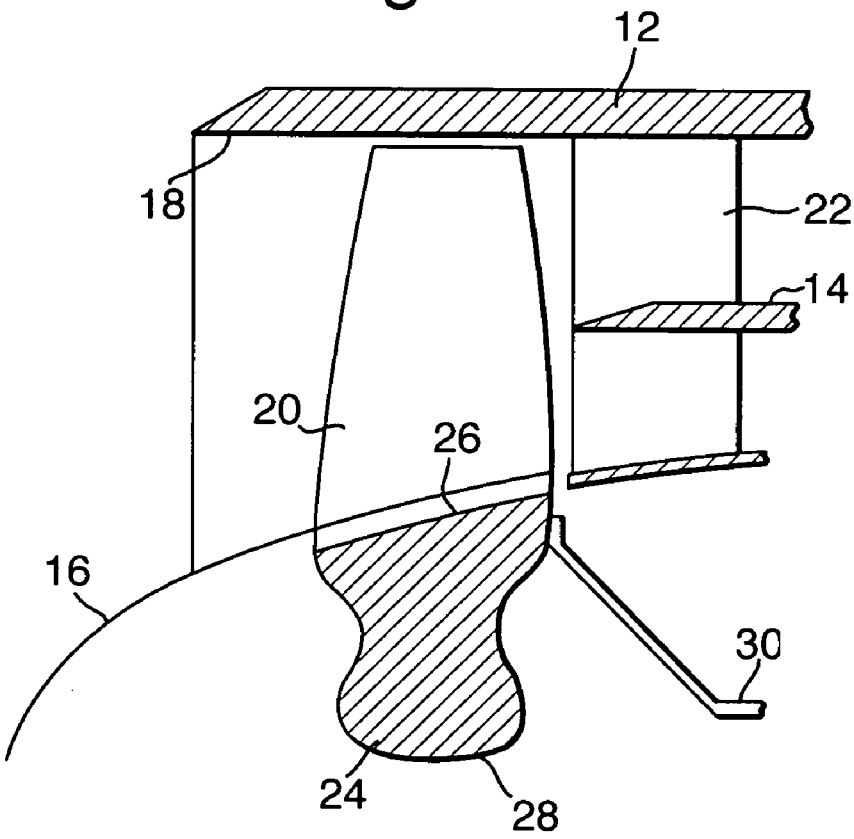
FIG. 2 shows a cross-section of a fan stage of the turbofan engine of FIG. 1.

FIG. 2 shows a cross-section of the fan 4 in more detail. The fan 4 comprises an annular duct 12 divided by a splitter 14. The duct 12 is defined by an inner wall 16 and outer wall 18. Within the duct 12 is located the rotary first stage 20 which comprises a rotatable annular array of aerofoil blades followed by the static secondary stage of static aerofoils 22 also referred to as stators. The blades 20 are mounted to a disc 24, evenly spaced about its annular periphery 26. They are faired at the interface with the disc 24 to form the inner wall 16 of the duct 12 in the region of the blade 20.

The disc/blade assembly 28, also called a rotor, is attached to a shaft 30, which rotates the rotor 28, causing the aerofoils 20 to rotate within the annular duct 12. This causes air to be drawn into the fan 4 and accelerated towards the stators 22 where it is slowed and pressurised.

The passage of the rotating blades 20 past the downstream stators 22 generates a fixed number of disturbances in the airflow around each blade 20 per rotation. Within the range of engine operating speeds, there is likely to be at least one condition at which the frequency of the disturbances coincides with a resonant frequency of the rotating blade 20. Such resonance must be damped to prevent damage to the engine.

Figure 3:
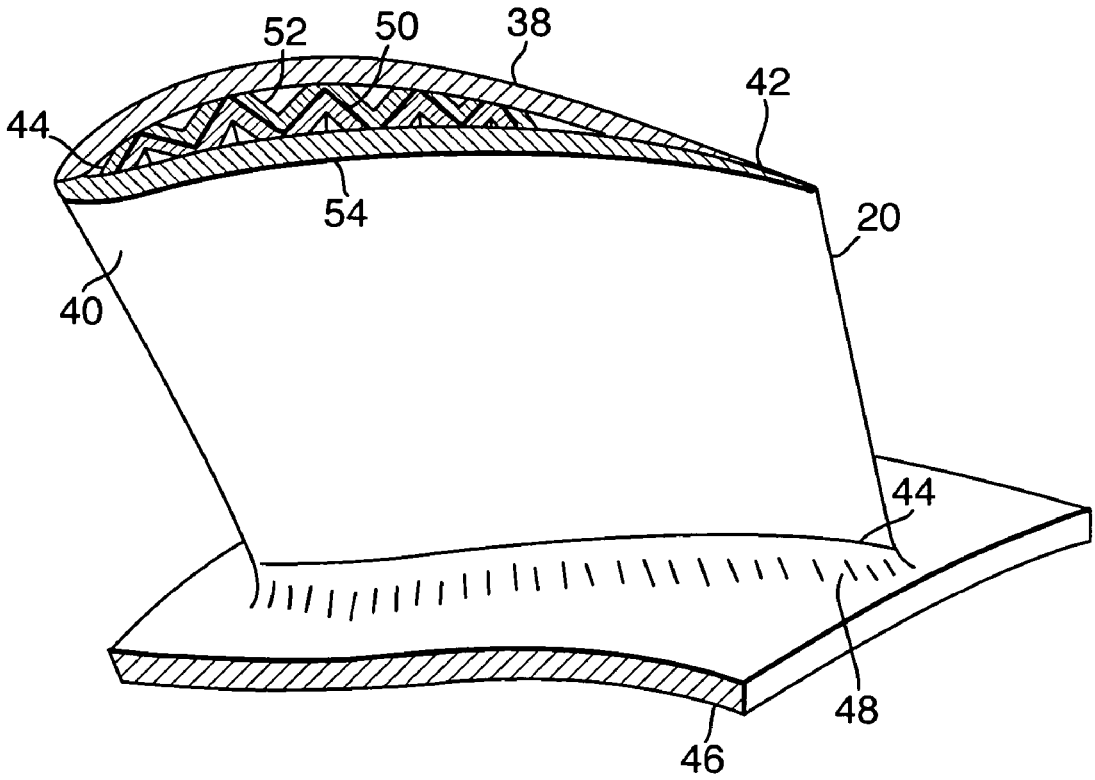
FIG. 3 shows a cross-section through a blade according to the present invention.

In accordance with the present invention damping is provided by the arrangement illustrated in FIG. 3, which shows a cross-section through an aerofoil blade 20. It will be understood that the aerofoil section of the blade 20 varies along its span and that the cross-section is for illustration of the invention only.

The blade 20 comprises a first wall 38 of a titanium alloy such as Ti-6AI4V, bonded to a second wall 40 of titanium alloy. The first and second walls (38,40) define a hollow aerofoil structure 42 with cavity 44. The blade 20 is sealed along its radially outer periphery (not shown) and the radially inner periphery is locally thickened to provide a foot for attachment to a disk 46 via linear friction welding to a stub 48 formed thereon.

Located within the aerofoil cavity 44 are damping means 50, comprising a first damping element 52 of titanium alloy and a second damping element 54 of titanium alloy. The damping elements 52,54 cooperate closely with one another to form reinforcing ribs, which in conjunction with the first and second walls 38 40 of the blade 20 form a structure known as a Warren girder. This structure comprises a row of interdigitate, substantially equilateral triangles. In this way, the damping means 50 provides structural support to the aerofoil structure 42 of the blade 20.

Figure 4:
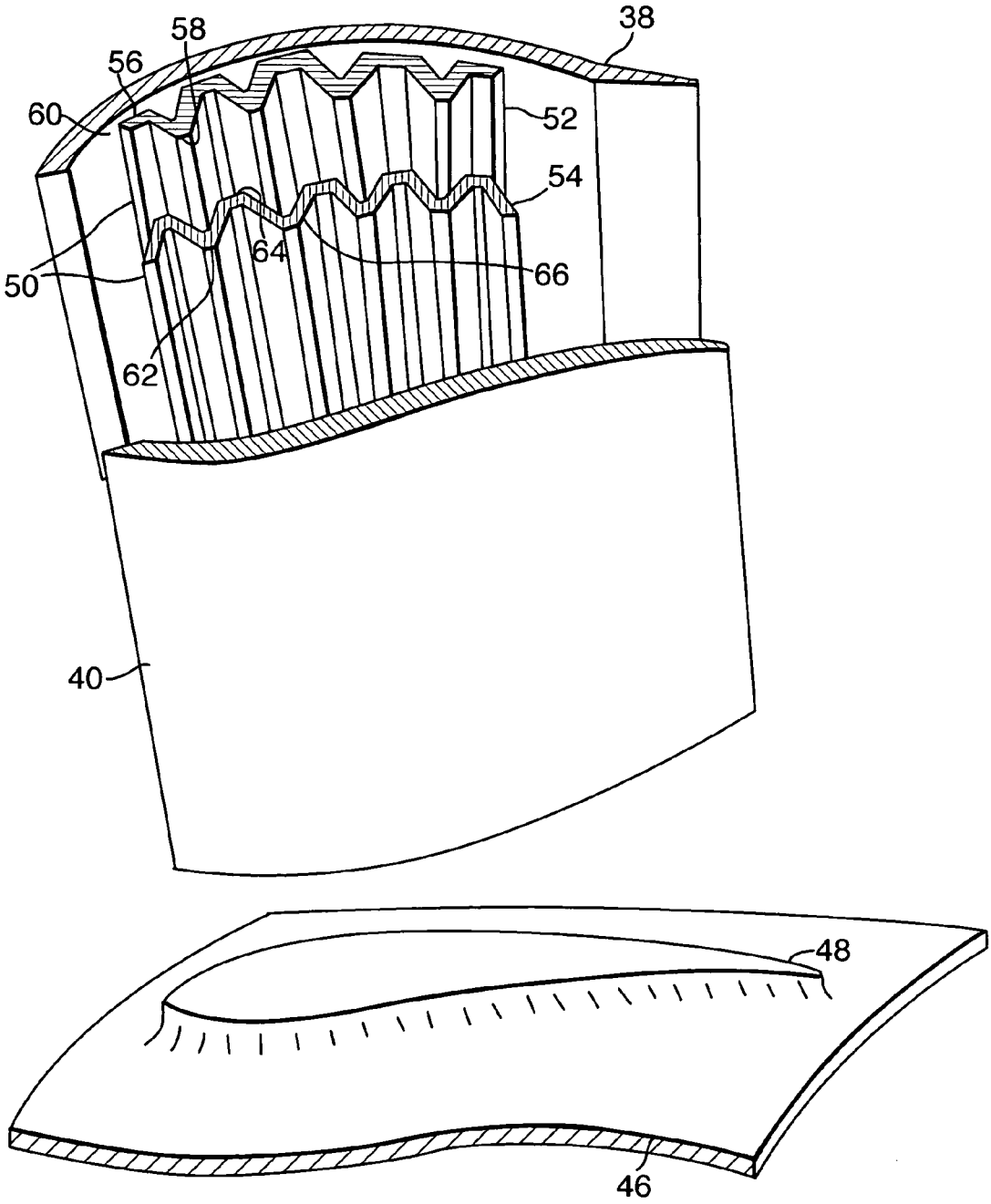
FIG. 4 shows an exploded view of the blade shown in FIG. 3.

The construction of the blade will be better understood if reference is now made to FIG. 4, which shows an exploded view of the aerofoil blade of FIG. 3. The first and second damping elements 52,54 are each corrugated elements, of substantially constant thickness. The first element 52 comprises an array of alternate wall lands 56 and narrower, inwardly spaced, friction lands 58 joined by diagonal elements 60. The second element 54 similarly comprises an array of alternate wall lands 62 and narrower, inwardly spaced friction lands 64 joined by diagonal elements 66.

The wall lands 56 of the first damping element 52 are bonded to the inside of the first blade wall 38 and the wall lands 62 of the second damping element are bonded to the inside of the second wall 40. The damping elements 52,54 are nestled so that the narrower friction lands 58 of the first element 52 are in rubbing contact against the wall elements 62 of the second element 54 and the narrower friction lands 64 of the second element 54 are in rubbing contact against the wall elements 56 of the first element 52. The diagonal elements 60,66 are arranged to lie substantially coplanar with one another, again in rubbing contact.

The Warren Girder formed by the first and second damping elements 52,54 cooperate to provide a support structure to the blade 20 by bridging the cavity 44 at a number of locations. This reinforces the aerofoil structure of the blade 20 without adding undue weight. Although the damping elements 52,54 are not bonded to one another, their closely cooperating shapes minimise relative movement therebetween so minimising any shortfall in performance when compared with a conventional, single-element, Warren girder design.

In operation, the blade may vibrate in a number of modes. In the case of torsional vibration for example, the blade 20 will twist along its axis, 'winding up' and then unwinding periodically. Such vibration of the blade 20 causes relative movement of the first and second walls 38,40. This in turn causes the lands 56,58,62,64 of the first and second damping elements 52,54 to rub, and also the diagonal elements 60,66. The friction thus generated converts the kinetic energy of the damping elements 52,54 into heat energy and so restrains movement of the first and second walls and damps vibration of the blade 20.

Figure 5:
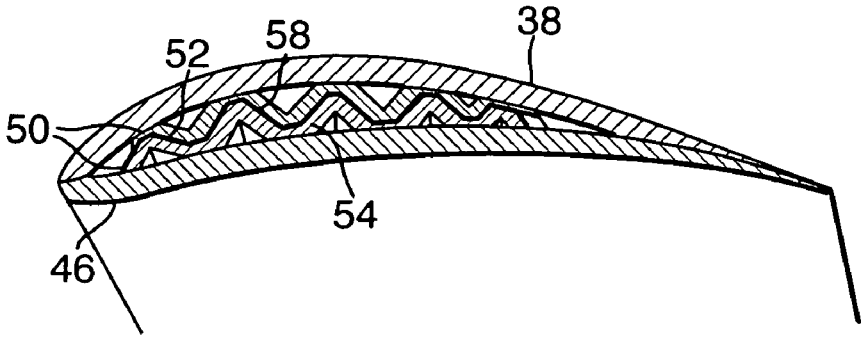
FIG. 5 shows a cross-section through an aerofoil blade according to a further embodiment of the present invention.

FIG. 5 shows the interface between first damping element 52 and second damping element 54 according to a further embodiment of the invention. The first damping element 52 is provided with a wear resistant coating 68 of ceramic which provides improved properties at the rubbing interface with the second damping element 54. In the embodiment shown, the ceramic-titanium interface exhibits reduced wear and improved friction properties over the titanium-titanium contact of the embodiment of FIG. 3. It will be understood, however, that both first and second damping elements 52,54 can be so coated such that the rubbing contact does not have a titanium component at all but instead has, for example, a ceramic-ceramic interface. In a further embodiment, different coatings may be applied to the damping elements 52,54 in order to further improve the damping qualities of the damping means 50.

Figure 6:
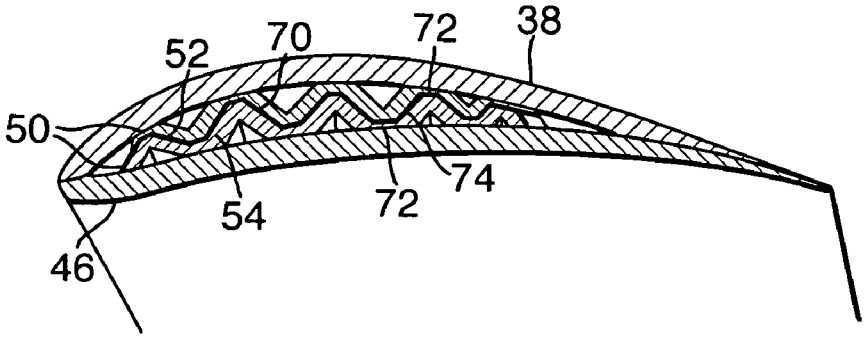
FIG. 6 shows a cross-section through an aerofoil blade according to another further embodiment of the present invention.

FIG. 6 shows another further embodiment of the damped aerofoil 20 according to the present invention. A third damping element 70 is provided which lies interposed the first and second damping elements 52,54. This element 70 is a corrugated sheet of softer material than the first and second damping elements 52,54, having friction lands 72 spaced apart by diagonal elements 74. The third element 70 is disposed with the blade 20 such that it lies nestled between first damping element 52 and second damping element 54 in rubbing contact with the wall lands 56 62, diagonal elements 60 66 and friction lands 58 64 thereof. The third element 70 is not fixed relative to the blade 20 but is held firmly by the other damping elements 52 54 which are bonded to the blade walls 38 40 as with previous embodiments of the present invention. In contrast with previous embodiments, relative movement of the first and second walls 38 40 of the blade 20 does not generate rubbing movement between first and second damping elements 38 40 and correspondent wear. Instead, the first damping element 38 and second damping element 40 rub against the third damping element 70. Hence the softer third element 70 wears in preference to the first and second damping elements 52 54, which form the structural Warren girder of the blade 20.

The aerofoil structure hereinbefore described is preferably manufactured by an adaptation of a process described in British Patent GB2269555 known as Superplastic Forming and Diffusion Bonding (SPFDB). The following description is intended to describe modifications to the process to allow a damped aerofoil according to the present invention to be manufactured.

Figure 7:
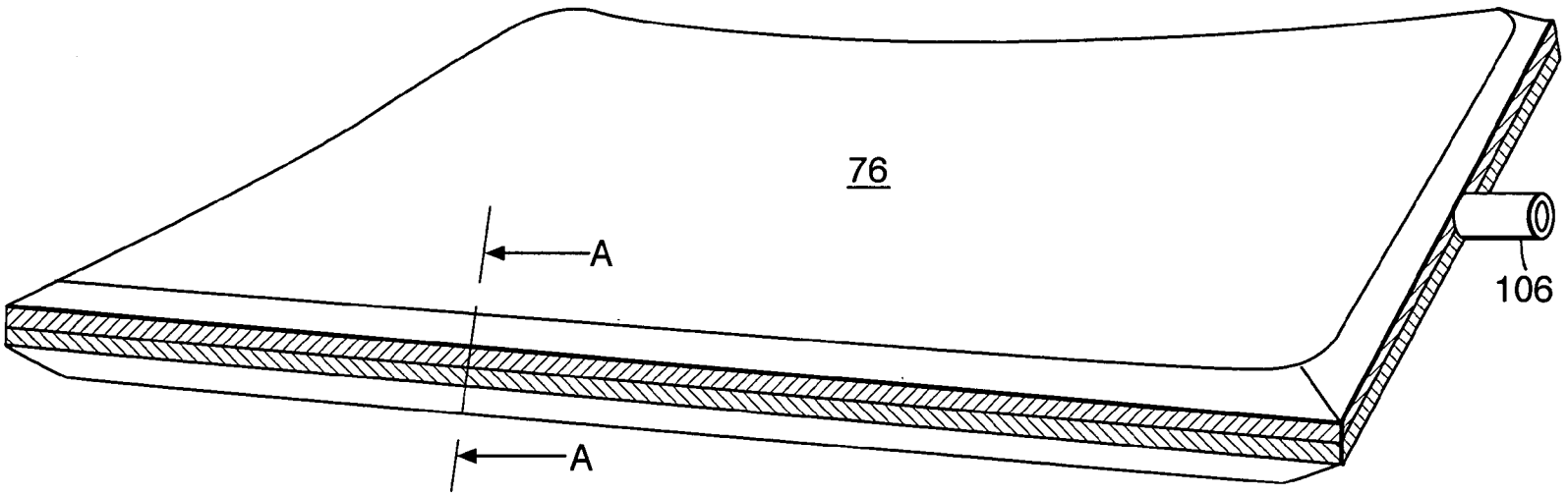
FIG. 7 shows a perspective view of a modified 'flat pack' from which an aerofoil according to the present invention is produced by a superplastic forming and diffusion bonding process (SPFDB)

FIG. 7 shows a perspective view of a modified 'flat pack' 76 from which the aerofoil 20 according to the present invention is produced. The flat pack comprises an assembly of titanium sheets, which are selectively bonded together, and then inflated to form the hollow aerofoil blade 20 of FIG. 3.

Figure 8:
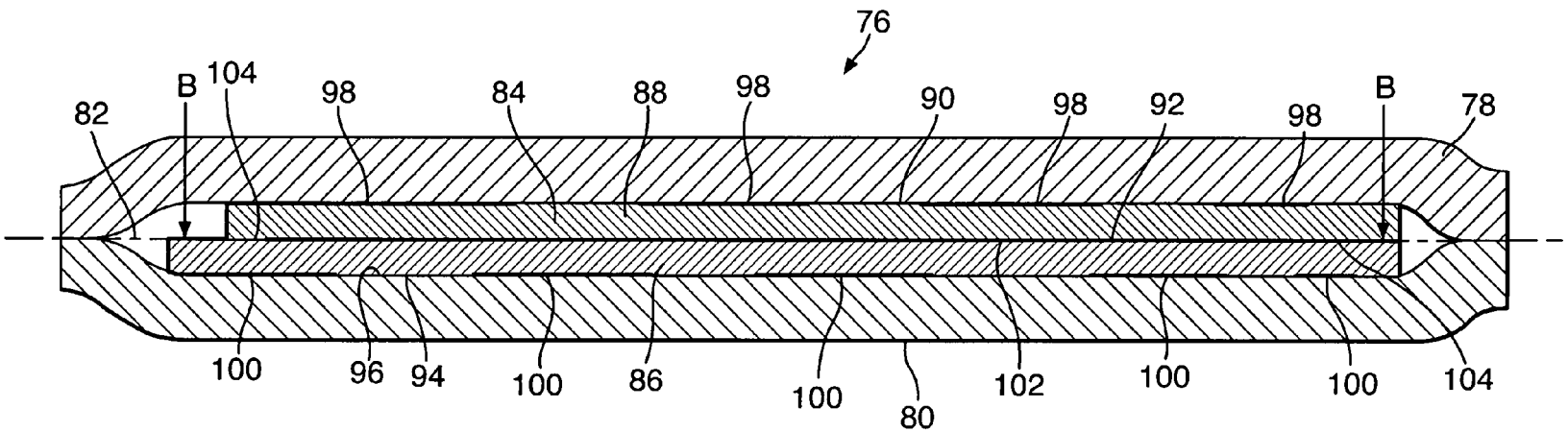
FIG. 8 shows a cross-section view of the modified flat pack of FIG. 7.

FIG. 8 shows a cross-section through the flat pack 76 of FIG. 7. The modified 'flat pack' 76 comprises a vertical array of stacked horizontal sheets. The stack comprises a first titanium alloy sheet 78 of variable thickness, which abuts a second titanium alloy sheet 80 of variable thickness, about its periphery. Both first and second sheets 78,80 are dished outwards from this periphery to create a cavity 82 between them, within which are located a third sheet 84 and fourth sheet 86 of similar titanium alloy. The third sheet 84 has a first surface 88, which lies against the inside surface 90 of the first wall 78, and a second surface 92 which lies against a first surface 92 of the fourth sheet 86. The second surface 94 of the fourth sheet 86 lies against the inside surface 96 of the second sheet 80. The third and fourth sheets 84,86 replace the 'line core' of a conventional SPFDB aerofoil, and form the first and second damping elements 52,54. The sheets 84 86 are each of substantially constant thickness, between around 0.2 mm and around 0.35 mm each. In a preferred embodiment, the thickness of each second and third sheet 84 86 is around 0.25 mm.

The interface between the first and third component 78 84 is selectively coated with a 'stop off' medium. This is applied in strips 98 which run along the axis of the finished blade 20 and prevents metal-metal contact between the first sheet 78 and third sheet 84 in the coated regions. Similarly, the same medium is applied selectively between the second and fourth sheets 80 86 in strips 100 running along the axis of the finished blade 20. The strips between first and third sheets 78 84 are offset relative to the strips 100 between second and fourth sheets 80 86 but are arranged to overlap slightly.

Figure 9:
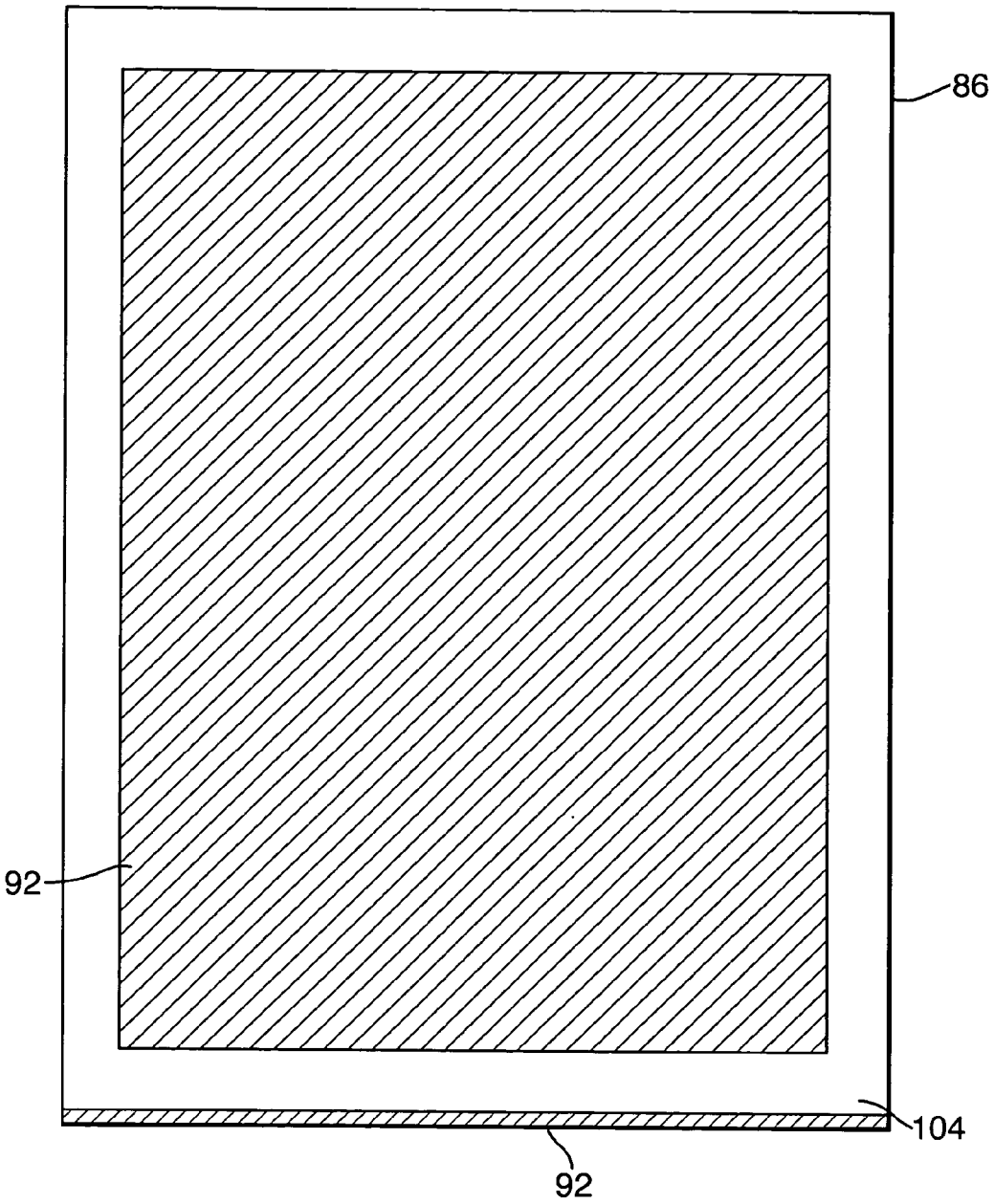
FIG. 9 shows a perspective view of the interface between second and third layers of the flat pack shown in FIG. 7.

A stop off material 102 is applied to substantially the entire interface between second and third sheets 84 86 except for a strip 104 running at or near to the perimeter of the two sheets 84 86. This is better understood if reference is made to FIG. 9, which shows a view on section B—B as indicated in FIG. 8.

During manufacture, the flat pack 76 is placed in a sealed bag (not shown), which is then evacuated. The flat pack 76 is heated to a temperature at which the sheets 78 80 84 86 diffusion bond together where in contact with one other. The first and second sheets 78 80 bond where they lie contiguous, sealing the cavity 82 about its periphery, apart from an opening to a tube 106.

The first sheet 78 bonds to the third sheet 80 between strips of stop off medium 98 and, similarly, the second and fourth layer bond together between strips of stop off media 100. The third and fourth sheets 84,86 bond only about their perimeter prevented by the stop off medium from diffusion bonding over the majority of their adjoining area and therefore lying substantially separate from one another.

Once the diffusion bonding process is complete, the flat pack 76 is isothermally forged to substantially produce the required finished peripheral shape. The integral structure of the flat pack is then heated to superplastic temperature and pressurised with inert gas via the opening 106. This causes the outer first and second sheet 78 80 to bow outwards from the cavity 82, which generates the exterior profile of the blade 20 and draws outwards the third and fourth sheets 84 86.

The third sheet 84 is superplastically drawn out with the first sheet 78 of the flat pack 76 where it is bonded thereto. Where not so bonded, pressurised gas prises the sheet 84 away from the first sheet 78. Similarly, the fourth sheet 86 is superplastically drawn out with the second sheet 80 of the flat pack 76 where it is bonded thereto, and where not so bonded is prised away from the second sheet 80 by the action of the gas.

The superplastic deformation of third and fourth sheets 84 86, due to the staggered arrangement of stop off strips 98,100, and because the third and fourth sheets 84 86 are fixed relative to one another about their periphery, generates the Warren girder structure of FIG. 3.

It will be understood that the Warren girder is the preferred type of girder however, other types of reinforced structure may be used such as a Praft girder or Howe girder.

By applying a superplastically formable ceramic hard coating to the interface between third and fourth sheets 84 86 the same method of manufacture can be used to produce the further embodiment of the invention shown in FIG. 5. Similarly, by interposing a sacrificial sheet (not shown), of a softer material, between the third and fourth sheets 84,86, the same method of manufacture can be used to produce the further embodiment of the invention shown in FIG. 6.

It not intended that the present manufactured example should limit the scope of the invention to a blade in which the third and fourth sheets 84 86 are entirely separate, apart from at their periphery 104, thereby allowing frictional engagement between damping elements 52 54 over substantially their entire area. For instance, by allowing selective bonding between third and fourth sheets 84 86, the damping properties can be tailored across the area of the finished blade 20.

A damped aerofoil 20 according to the present invention lends itself to the method of manufacture outlined above, however it is not intended that this specification should be limited to an aerofoil manufactured by such a route. Similarly, the materials used for the aerofoil described herein are not intended to be limiting. Titanium alloys lend themselves to the SPFDB process as do a range of metals, metal alloys, intermetallic materials and metal matrix composites. However, an aerofoil 20 according to the present invention may also be produced via a different manufacturing route such as bonding via 'super-adhesives' from non-metallic materials such as carbon-fibre composites.

A damped aerofoil 20 according to the present invention is applicable to aerofoil structures other than rotating blades 20 within a gas turbine engine. Such structures include stators 22 and bearing support struts for the rotating shaft 30.

The invention claimed is:

1. A damped aerofoil structure manufactured by a superplastic forming process, comprising:

an aerofoil having a first wall and a second opposing wall; and vibration damping means for damping relative movement of the first and second wall, wherein the vibration damping means comprises at least two cooperating damping elements, a first damping element mounted to the first wall of the structure and a second damping element mounted to the second wall of the structure, and the first and second damping elements are formed from a first sheet and a second sheet, the first and second sheets being joined about their periphery.

2. A damped aerofoil structure as claimed in claim 1 wherein the first wall and second wall together define an enclosed cavity, and the vibration damping means is located within the cavity, the first damping element mounted to the inner surface of the first wall of the structure and the second damping element mounted to the inner surface of the second wall of the structure.

3. A damped aerofoil structure as claimed in claim 1 wherein the damping means provides structural support to the aerofoil structure.

4. A damped aerofoil structure as claimed in claim 1 wherein the damping means forms reinforcing ribs that cooperate with the first and second wall of the aerofoil to form a girder structure.

5. A damped aerofoil structure as claimed in claim 4 wherein the girder structure comprises a Warren girder.

6. A damped aerofoil structure as claimed in claim 1 wherein the first and second damping elements are in nestled arrangement.

7. A damped aerofoil structure as claimed in claim 1 wherein the first, second and third damping elements are in nestled arrangement.

8. A damped aerofoil structure as claimed in claim 1 wherein the first and second damping elements comprise corrugated sheets.

9. A damped aerofoil structure as claimed in claim 1 wherein the first, second and third damping elements comprise corrugated sheets.

10. A damped aerofoil structure as claimed in claim 1 wherein the first and second damping elements are bonded to one another about their periphery.

11. A damped aerofoil structure as claimed in claim 10 wherein the first and second damping elements are diffusion bonded to one another about their periphery.

12. A damped aero foil structure as claimed in claim 1 wherein the first and second damping elements are manufactured by a superplastic forming process.

13. A damped aerofoil structure as claimed in claim 1 wherein the third damping element is manufactured by a superplastic forming process.

14. A damped aerofoil structure as claimed in claim 1 wherein the first and second damping elements are manufactured from a titanium alloy.

15. A damped aero foil structure as claimed in claim 1 wherein the third damping element is manufactured from a titanium alloy.

16. A damped aerofoil structure as claimed in claim 1 wherein at least one of the first and second damping elements is coated with a hard coating.

17. A damped aerofoil structure as claimed in claim 16 wherein the hard coating is a ceramic material.

18. A damped aerofoil structure as claimed in claim 16 wherein the hard coating is applied to both first and second damping elements.

19. A fan of a turbofan engine including the damped aerofoil structure as claimed in claim 1.

20. A damped aerofoil structure as claimed in claim 1, wherein the first and second sheets are joined about their periphery but otherwise substantially separated from one another.

21. A damped aerofoil structure, comprising:

an aerofoil having a first wall and a second opposing wall; and vibration damping means for damping relative movement of the first and second wall, wherein the vibration damping means comprises at least two cooperating damping elements, a first damping element mounted to the first wall of the structure and a second damping element mounted to the second wall of the structure, and at least one of the first and second damping elements is coated with a hard ceramic coating.

22. A damped aerofoil according to claim 21, wherein the aerofoil structure is manufactured by a superplastic forming process whereby the first and second damping elements are formed from a first sheet and second sheet, the first and second sheets being joined about their periphery but otherwise substantially separated from one another.

* * * * *